United States Patent [19]

Howard

[11] Patent Number: 4,647,250

[45] Date of Patent: Mar. 3, 1987

[54] CANADIAN FLEXIBLE DAMS

[76] Inventor: Ralph H. Howard, 80 Somerville Ave., Westmount, Que., Canada, H3Z 1J5

[21] Appl. No.: 487,465

[22] Filed: Apr. 18, 1983

[51] Int. Cl.[4] ..... E02B 7/00

[52] U.S. Cl. ..... 405/115; 405/91

[58] Field of Search ..... 405/115, 91, 92, 80, 405/52

[56] References Cited

U.S. PATENT DOCUMENTS 4,252,461 2/1981 Colamussi et al. ..... 405/115

FOREIGN PATENT DOCUMENTS 0618481 8/1978 U.S.S.R. ..... 405/115

0622923 9/1978 U.S.S.R. ..... 405/115

0653328 3/1979 U.S.S.R. ..... 405/115

0669002 6/1979 U.S.S.R. ..... 405/115

*Primary Examiner*—Dennis E. Taylor

[57] ABSTRACT

The present invention deals with flexible wall dams used for restricting the flow of rivers, seawaters, or the like, using in combination: an upstanding, continuous, impermeable, inextensible, reinforced, flexible wall having elongated upper and lower peripheral edges, with the lower edge positively and substantially sealingly secured to the base of the waterbed by being inserted into a curvaceous longitudinal channel anchored to the waterbed, and the upper edge supported by means of floating vessels, transferring their loads through anchoring cables to points upstream.

31 Claims, 12 Drawing Figures

2 F.W.
D5
D5A
30
31
18
17
C4
D6-7
23
25
24
V2
D8
1
38
9
9A
8A,B
39
8C,D
37
34
33
3
V1
10
32
40
10B
10C
C2
5
D9A
6
4
C1
7
45
C5
28
D9
42
43
9B
41
8E,F
44
36
10A
35
10D
V3
27
29

FIG. 4
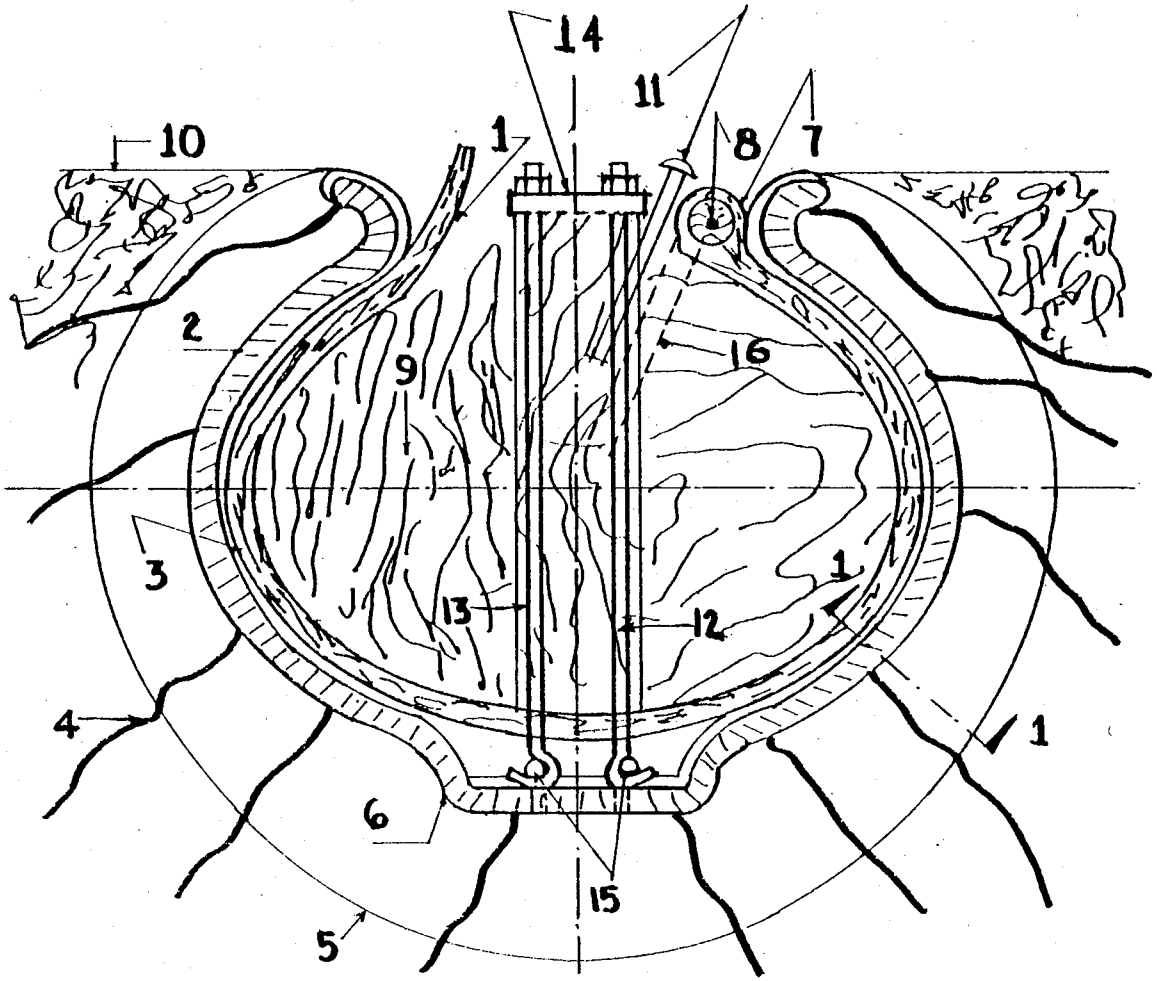
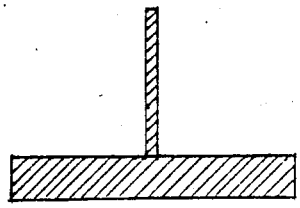
FIG-4A

CANADIAN FLEXIBLE DAMS

The present invention deals with massive flexible dams for relatively deep water bodies and high water-head courses of water, using a combination of:

High tensile strength, cross reinforced, flexible, impermeable, inextensible plate (referred to hereafter as flexible wall and abbreviated as FW) specially designed and fitted to be installed strip by strip on the job site.

An anchoring system to anchor the lower edge of the flexible wall tightly and firmly to the waterbed.

Used ships, destined for retirement, adjusted and fitted to be anchored and to support the flexible wall by means of ties connected to independent motorized equipment mounted inside the ships.

Cable beams to support the back of the flexible wall and break the span of the flexible wall in between the waterbed and the surface of the water, which cable beams transfer their loads through the flexible wall to anchoring and supporting ties upstream.

A spring-like flexible connection to tie the upper edges of the flexible wall to the used ships.

Independent motorized systems fastened inside the ships and connected to the ties transferring the loads from the upper edges of the flexible wall.

Independent motorized systems fastened inside the ships and connected to the ties tying the ships to their anchoring sites. The role of the motorized systems is to adjust to the water level and the snow pressure on the dam.

An anchoring concrete platform anchored to the waterbed through piles driven in the waterbed and anchored to the tubular channel holding the lower edge of the flexible wall by means of reinforcing rods welded to said channel.

Flexible spouts connected to openings made in the flexible wall about the height of the low water level, used to discharge the water into electric generating turbines mounted on secondary vessels stationed at the low water side.

A sediment flushing out system through tunnels beginning upstream ahead of the anchoring lines and extending downstream beyond the flexible wall.

A set of specially designed accessories to tie the different components of the dam to each other.

A flexible design applicable to shallow and deep water dams where no previous methods could apply, taken into consideration:

A—The question of reducing the collossal size of the dams to a featherweight, flexible membrane.

B—An installation design allowing the erection of the flexible wall step by step on the dam site.

C—The question of easy anchoring, repair and replacement of the flexible wall.

D—Recycling of very valuable used ships destined for retirement.

E—Reducing the dam construction time to one tenth of the time needed for conventional dams.

F—And the most important of all, reducing the overall cost of the dams to less than one tenth of the original cost of the conventional dams known till now.

DRAWINGS

FIGS. 4 and 4A show shows the anchoring system of the lower edge of the flexible wall to the waterbed.

NOTE: Nos. in circles represent group of pieces and are referred to as elements.

DETAILS

The present invention named hereafter Canadian flexible dams and abbreviated as CFD, deals with large, deep water, flexible dams for relatively deep water bodies and high waterhead water courses using a combination of:

High tensile strength, cross reinforced, flexible, impermeable, inextensible plate made of fabric, rubber or rubberized material or the like.

Figure 5:
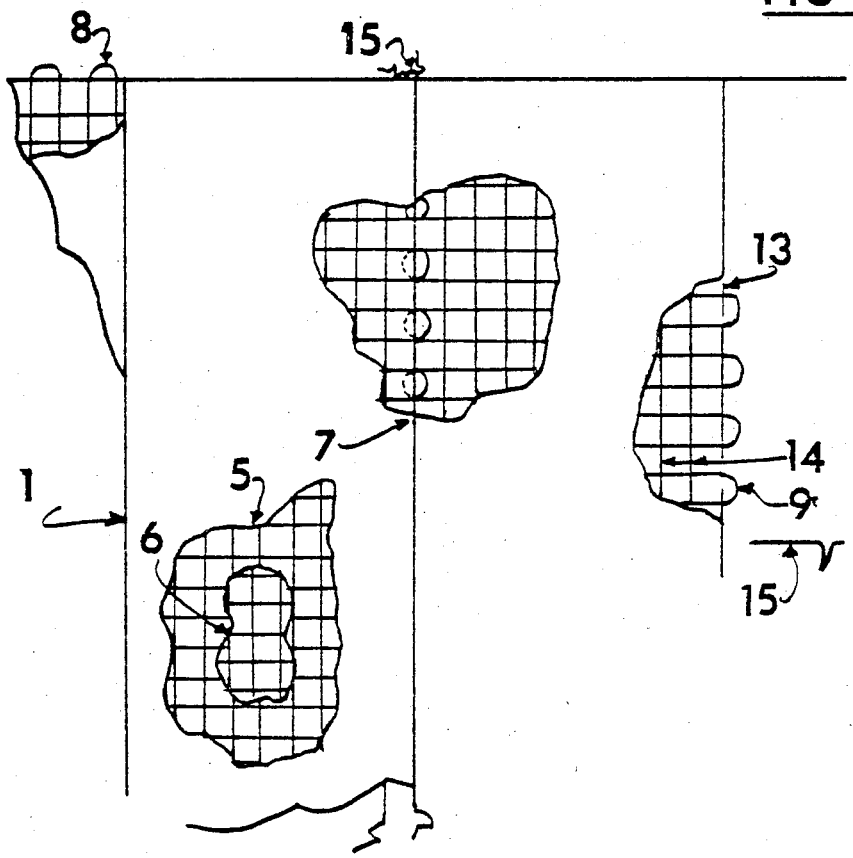
FIGS. 5–5F shows the reinforcement and the splicing of the flexible wall.
Figure 5A:
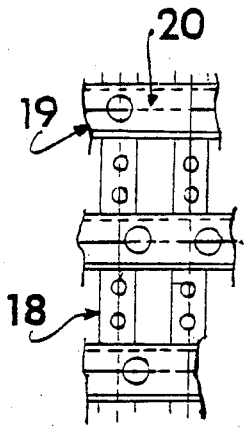
Figure 5B:
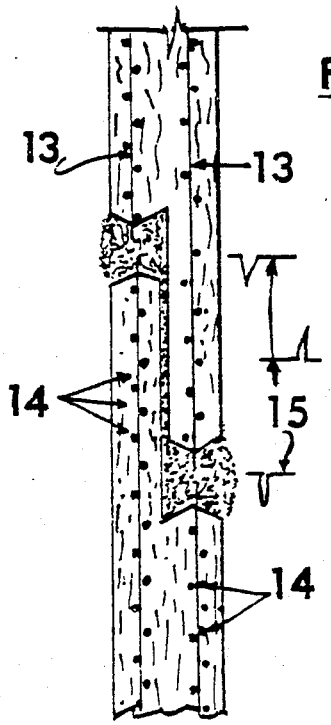
Figure 5C:
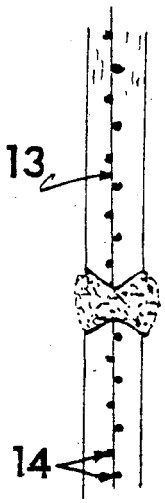
Figure 5D:
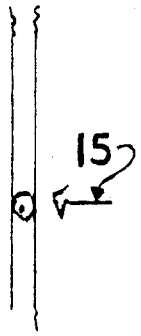
Figure 5F:
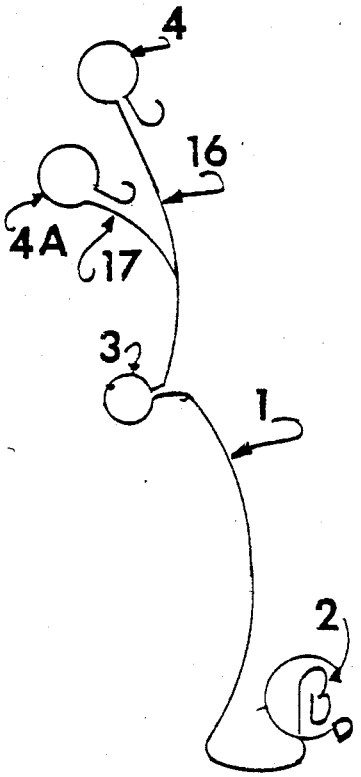
Figure 5E:
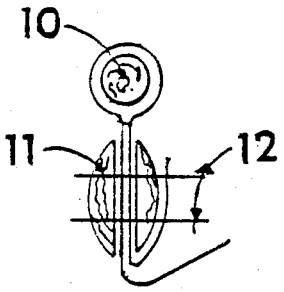

The flexible wall consists of reinforced longitudinal strips like those used for conveyor belts, redesigned with cross reinforcement, where the reinforcement is left protruding with forms of loops and zigzags (See FIG. 5, No.9) to allow for joint splicing all along the strips by inserting wire cables consecutively through the adjacent loops of the strips to be joined (See FIG. 5, No. 7) moreover these loops of the adjacent strips are tied together with special ties, a fact which makes the joint strong and firm developing the same strength of the plate itself and by applying the rubberized flexible compound the joint would be watertight as well, the same as the main part of the flexible plate.

This design of the flexible plate allows us to install the flexible wall on the dam site gradually in sections strip by strip which fact makes possible the erection of dams with limitless length without having the handicap of transporting the whole flexible wall from the factory to the site of the dam.

Using in combination a curvaceous tube imbedded and anchored to the concrete platform on the waterbed. (See FIG. 4, Det. 8).

The lower edge of the flexible wall is inserted through the curvaceous tube and locked in tightly by means of longitudinal blocks wedged together to interlock and squeeze tightly and firmly the flexible wall inside the tube.

The lower end of the flexible wall is inserted inside the tube and folded around longitudinal blocks and fastened around them to prevent the slippage of the flexible wall in between the walls of the tube and the longitudinal blocks. (See FIG. 4, Det. D8, FIG. 5, Det. D).

In certain cases, the lower tip end of the flexible wall is rolled over, and inserted in between the longitudinal blocks installed inside the longitudinal tube, and when these blocks interlock with each other, they squeeze the end of the flexible wall in between them and prevent it from slipping away (See FIG. 4).

Using in conjunction, used ships, (See FIG. 1, Element 3) used barges and used watergoing vessels of any kind that had served their time or had paid back their capital investment and are destined for retirement for their inefficient internal equipment but that they could still deliver safely their floating capacity. The choice of such ships that are usually destined for scrap is the intersection of different points of consideration: economical, technical, availability, applicability, etc., which, in combination with the specially designed flexible wall (See FIG. 5), the supporting cable beams on the back of the flexible wall and the other related features, makes it possible the breakthrough from the existing toy size flexible dams to the present giant dams that the present invention applies for to replace the conventional solid dams used up till now.

These used ships could be open ships and do not have to be closed floating bodies as the previous inventions called for nor inflated as the previous inventions called for.

These used vessels are used to support the upper edges of the flexible wall, connected to them at different levels through a series of pulleys and cables passing through the vessels and fastened to equipment inside the vessels.

These used ships transfer the loads, applied to them from the flexible wall, to the anchoring cables connected to them at different levels on the opposite side of the flexible wall, (See FIG. 2), which cables extend upstream to their anchoring points on the waterbed or on other fixed points upstream.

The used ships are lined longitudinally one next to the other on the high water side inside the flexible wall and all along the dam.

Figure 1:
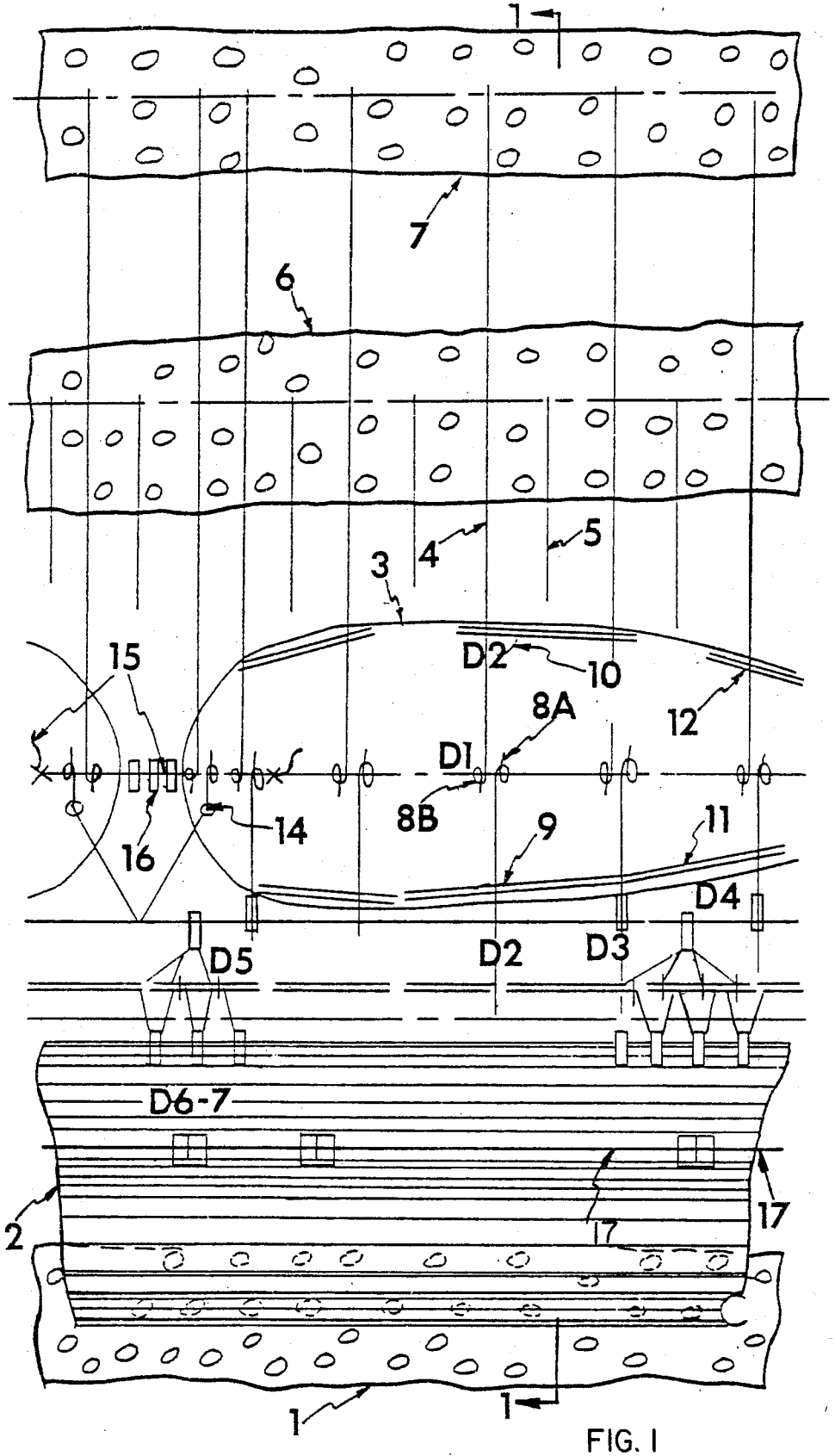
FIG. 1 shows a plan view of the dam.

The ships are tied to each other along the length with heavy wire cables keeping them slightly staggered and with a fixed spacing and some compressible separators in between the edges of the ships to prevent and minimize collision (See FIG. 1).

The edges of the decks of the ships receiving the loads from the flexible wall and the opposite edges receiving the anchoring cables are provided with longitudinal blocks all along the decks of the ships to distribute the loads applied to them from the flexible wall and from the anchoring cables. (See. FIG. 1).

Using in combination supporting cable beams (See FIG. 1, Element 17) on the back of the flexible wall at different distances in between the waterbed and the surface of the water; to break the span of the flexible wall in between the waterbed and the surface of the water.

These cables play the role of reversed beams supporting the back of the flexible wall. The cables transfer the loads applied to them from the flexible wall to anchoring cables connected to them, through the flexible wall, with special connections.

Some of the anchoring cables (See FIG. 2, Element 5), extend directly upstream to anchoring points on the waterbed or on other fixed points upstream, while other anchoring cables, extend upstream to be connected to the decks of additional vessels, stationed upstream on the high water level; in turn, the additional vessels are anchored upstream in the same way as the main vessels V1. (See FIG. 2).

The supporting cables are made flat cables to enlarge the bearing area of the cable and reduce the concentrated stress on the back of the flexible wall.

Figure 3:
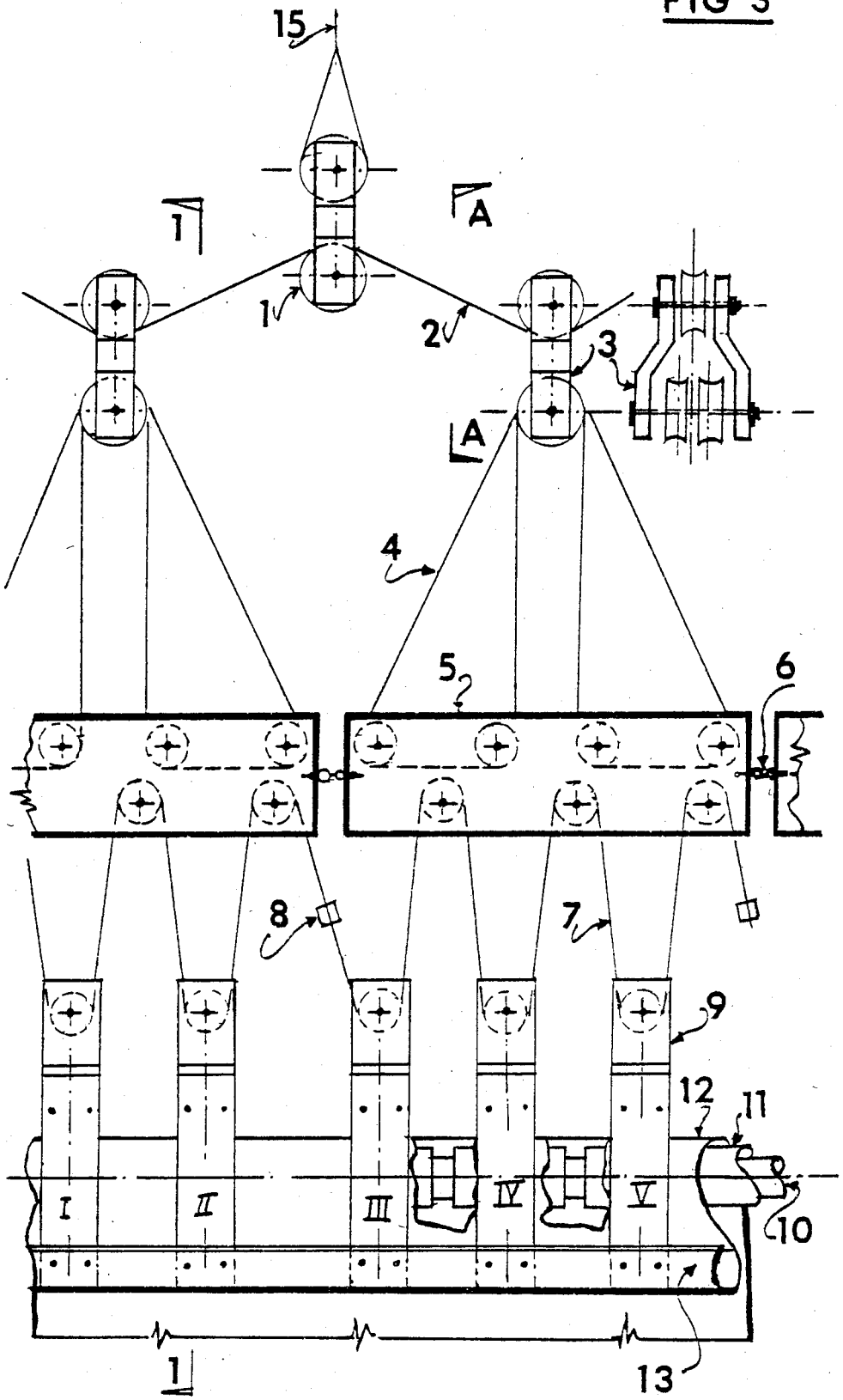
FIG. 3 shows the connection of the top edge of the flexible wall to the supporting vessels.

Using in combination springlike flexible systems to transfer the stresses at different levels from the top edges of the flexible wall to the ships (See FIG. 1, FIG. 3, det. D5) consisting of wide clamps, No. 9, clamping the top edges of the flexible wall, No. 12, which is rolled over a wire rope, No. 10, that is covered with sections of solid pipes, No. 11, to enlarge the overall diameter clamped by said clamps whose jaws are bolted also to each other through the flexible wall.

The upper end of the clamps is provided with a pulley supported by continuous cable, No. 7, which cable is itself supported by another pulley mounted on double beam structure, No. 5, which beam is attached itself to another cable, No. 4, that is carried by the block of pulleys, No. 3, that is hanging down from the header cable, No. 2, and the header cable No. 2 is supported by a block of pulleys suspended from cable No. 15, (See FIG. 3) which ties the whole system to the ships. The cables No. 15 pass through watertight holes provided at different levels on the outer walls of the ships, facing the flexible wall, then cables 15 pass over bearing drums mounted on the edges of decks inside the ships, (See FIG. 1, Element 9), and continue inside the vessels to be fastened to independently operated motorized drums fastened inside the said vessels.

The role of the system connecting the top edges of the flexible wall to the ships is to prevent excessive concentrated loads from splitting off the top edge of the flexible wall; in such a way that if there is a high pressure on one edge of the flexible wall the cable No. 7 is pulled longer towards that high pressure area and shorter where the pressure is lower until the pressure equalizes along the top edge of the flexible wall.

The cable No. 4 plays the same role by allowing the beam No. 5 to tilt towards the high pressure area. The combination of cables No. 4 and No. 7 with the sets of pulleys connecting to them result in a spring like action to protect the top edge of the flexible wall from splitting under excessive concentrated loads.

The role of the solid dual beams, No. 5, is to keep the top edge of the flexible wall close to the straight line and preventing it from excessive folding which fact could cause the breakage of the cable No. 10, and eventually the splitting of the top edge of the flexible wall.

Using in combination independently operated motorized systems fastened inside the vessels and connected to the ties like No. 15 (FIG. 3) transferring the loads from the upper edges of the flexible wall to said motorized systems.

The role of these motorized systems is to move the flexible wall to and from the vessels.

The position of the flexible wall with reference to the vessels needs to be adjusted when the water level in the dam changes up or down.

Figure 2:
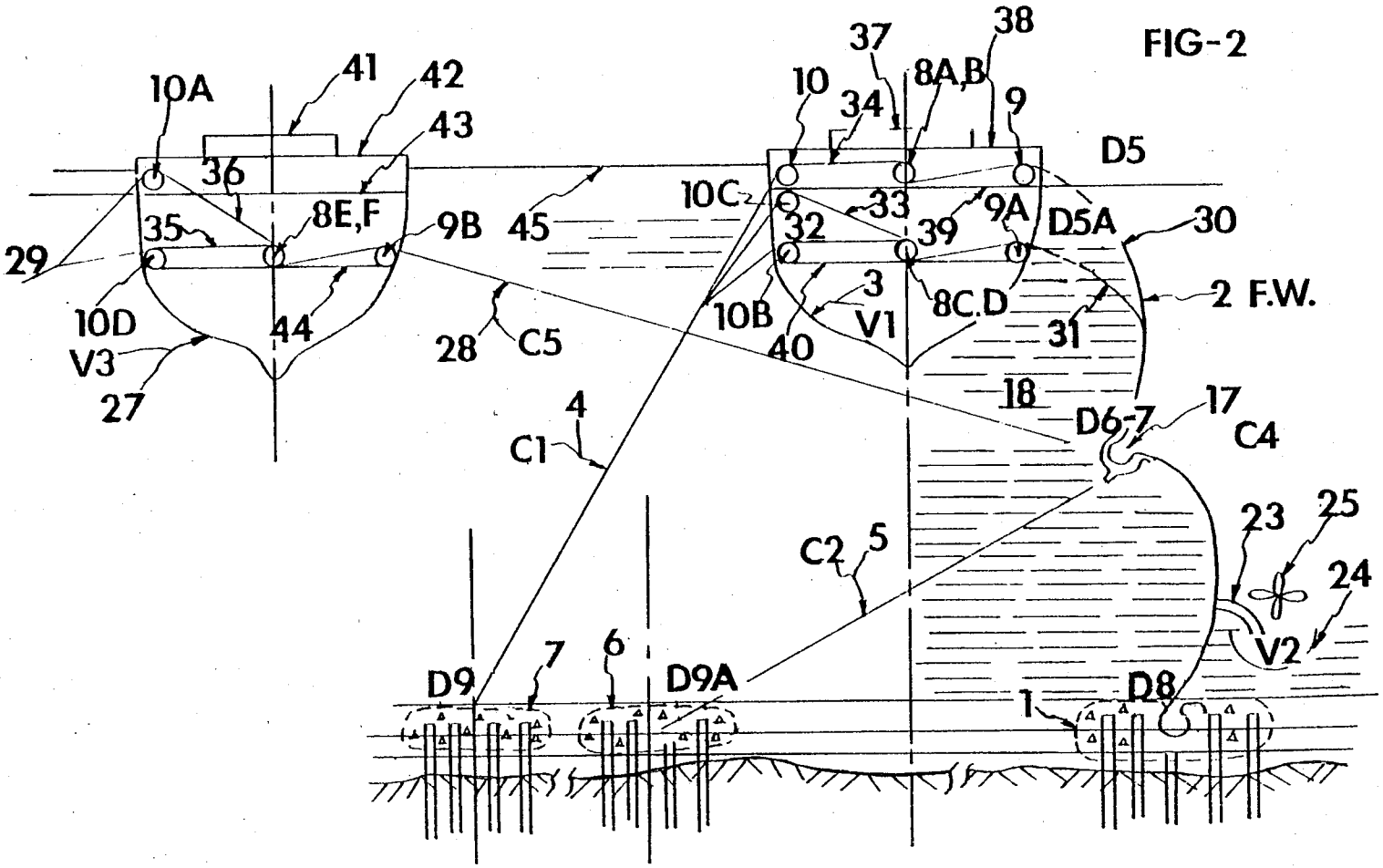
FIG. 2 shows a cross section of the dam shown in FIG. 1.

Using in combination independently operated motorized systems fastened inside the vessels, connected to the anchoring ties like Element 4, See FIG. 1 and FIG. 2, tying the vessels to their anchoring sites.

The role of these motorized systems is to move the vessels to and from their anchoring sites.

The position of the vessels with reference to their anchoring sites had to be adjusted when the water level in the dam rises or goes down. At the same time, when solid ice accumulates in front of the vessels, the anchoring ties have to be released and this can be done through the motorized systems.

(See FIG. 4) Using in combination an anchoring system binding the curvaceous tube, holding the lower end of the flexible wall, to the concrete platform and to the waterbed by using reinforcing steel bars welded to the curvaceous tube system and rooting down through a concrete platform cast at the surface of the waterbed.

The concrete platform cast at the surface of the waterbed is itself anchored to the waterbed through:

A—Concrete piles driven in the waterbed and with their upper reinforcement left protruding through the concrete platform.

B—Wooden piles driven in the waterbed and provided at their upper end with transversal holes through which reinforcing steel bars are passed through and left protruding out through the concrete platform to serve as anchorage between the piles and the concrete platform itself.

Providing in combination holes in the flexible wall at about the level of the low water surface, which holes are connected to flexible spouts, Element 23, extending downstream beyond the flexible wall on the low water area.

These spouts are used to discharge the water from the high water level through the flexible wall to electric generating turbines, Element 25, mounted on secondary vessels, Element 24, stationed on the low water side.

The flexible spouts are supported on a pivoting structure connected from one side to the spouts and resting on a mobile mechanism that rolls over the decks of the secondary ships, Element 24, to allow free movement of the said ships when the low water level changes up or down.

Using in conjunction a sediment flushing out system through closed tunnels, Element 20, at the surface of the waterbed, beginning upstream ahead of the ties anchoring sites and extending downstream to discharge the sediments somewhere downstream beyond the flexible wall.

The flushing out system is provided with a kind of screen in front of the tunnels consisting of piles, driven into the waterbed and protruding up for a distance above the waterbed. Their role is to prevent heavy rocks and debris from blocking the mouth of the tunnels.

The tunnels are provided with locks, at the beginning of the tunnels to allow opening and closing the wter through the tunnels.

Providing in combination a series of accessories, especially designed clamps and connectors to make the tie in between the different parts of the dam.

A fitted combination insuring at the same time;

A flexible dam design adaptable to any kind of dams in order to replace the methods used up till now with the conventional construction methods, flexible or solid, for dams even deeper than what it was possible with the existing methods and to dams with unlimited length.

An easy way of construction and on site joining the parts and erecting the flexible wall strip by strip in a way that insures the full strength of the plate all along the joints. This solution makes it possible the construction of dams with limitless length without having the impossible inconvenience to have the flexible wall joined in the workship and transported in one unit to the site of the dam. Add to that, an easy way of repair and replacement, pulling out and re-anchoring the flexible wall to the waterbed.

A large overall saving in money and time that the present invention realizes over all the patents existing till now.

Points to be considered:

When the water level in the dam falls down, the buoyants fall down with the water, and having the same length of ties tying them to their anchoring sites, they will move downstream allowing the flexible wall to bulge out like an apron carrying the water of the dam and transferring its weight to the buoyants which fact could drown the buoyants.

To avoid this unnecessary stress on the flexible wall, the ties and the buoyants, the buoyants should be pulled upstream until the apron shape formed by the flexible wall disappears and the flexible wall would take the shape of a blanket cover over the water of the dam. In this case, the anchoring line on the waterbed of the lower end of the flexible wall would be positioned downstream beyond the line of projection of the top edges of the flexible wall on the waterbed and also beyond the line of projection of any cable beam, supporting the back of the flexible wall on the waterbed.

Joining the strips to form the flexible wall;

Splices should be 200% as strong as the main part of the strips forming the flexible wall, to insure double margin of safety.

Special hardware should be fastened inside the protruding loops, used to splice the strips of the flexible wall, to prevent excessive folding or flattening of the said loops, which fact causes the wires of the loops to break.

The wire ropes or the cords joining the adjacent loops, coming from the adjacent strips, is to be inserted and reinserted and interwoven with the loops and through the hardware installed inside the loops, to avoid slackening and pulling out of the joining wire.

Apart form the cords inserted through the loops, the adjacent loops should be tied together with special connectors insuring the transfer of 100% of the strength of the loops in between each other.

The embodiment of the invention in which an exclusive property and privileges claimed are defined as follows:

1. An all water tight, high water head, flexible will dam, designed with a provision to be joined on site, applicable for substantially large dams with relatively high water head, for hydro power plants and high water head reservoirs, with detachable anchoring system between the flexible wall and the water bed, resulting in a high water head flexible wall dam, made substantially as described, for use in restraining the flow of river, sea water or the like, comprising in combination: an upstanding flexible wall, having elongated upper and lower peripheral edges, with the lower edge positively and substantially sealingly secured to the river bed or the like, and the upper peripheral edge secured to at least one elongated floating vessel by means via a first side thereof, said vessel being located upstream of said wall and anchored in a position by a first anchoring means secured in the river bed upstream of said vessel, whereby said wall and vessel lie in substantially parallel relation one to another, said first anchoring means including first cable means secured to said vessel via a second and opposite side thereof,

2. A flexible wall dam as defined in claim 1, including at least one further elongated floating vessel anchored in position upstream and behind said first vessel by a second anchoring means secured in the river bed upstream of said further vessel, said second anchoring means including second cable means secured to said further vessel via a first upstream side thereof, whereby said further vessel lies in spaced substantially parallel in relation to said other vessel and third cable means secured to said further vessel via a second and opposite side thereof and extending to secure said wall intermediate said upper and lower edges.

3. A flexible wall dam as defined in claims 1 or 2, including a further anchoring means secured in the river bed upstream of said wall, said further anchoring means including cable means extending to secure to said wall intermediate said upper and lower edges.

4. A flexible wall dam as defined in claim 1, wherein said upper wall edge is secured in spaced relation to said at least one vessel.

5. A flexible wall dam as defined in claim 1, including cable means secured to said at least one vessel via said first side at a position below said securement of said upper edge, and extending to secure to said wall intermediate said upper and lower edges.

6. A flexible wall dam as defined in claim 4, wherein said upper wall edge securement comprises said upper wall edge being interconnected to said vessel by a system of cables or the like and pulleyblocks, cables or the like of which wrap around winch means on said vessel subsequent to passing over roller means adjacent said first side.

7. A flexible wall dam as defined in claim 1, wherein said first cable means wraps around winch means on said vessel subsequent to passing over roller means adjacent said second side.

8. A flexible wall dam as defined in claim 5, wherein said cable means wraps around winch means on said vessel subsequent to passing over roller means adjacent said first side.

9. A flexible wall dam as defined in claim 7, wherein a further cable means is secured to said first cable means intermediate said first anchoring means and said vessel, said further cable means wraps around winch means on said vessel subsequent to passing over roller means adjacent said second side.

10. A flexible wall dam as defined in claim 9, including additional cable means secured to said first cable means intermediate said first anchoring means and said vessel, said additional cable means wrapping around winch means adjacent said second side and intermediate said roller means adjacent said second side.

11. A flexible wall dam as defined in claim 2, wherein said second cable means wraps around winch means on said vessel subsequent to passing over roller means adjacent said first upstream side.

12. A flexible wall dam as defined in claim 11, including additional cable means secured to said second cable means intermediate said second anchor means and said vessel, said additional cable means wrapping around winch means on said vessel subsequent to passing over roller means adjacent said first upstream side and located below said roller means adjacent said first upstream side.

13. A flexible wall dam as defined in claim 1, wherein the securement of said lower peripheral edge to the water bed comprises an elongated member around which said flexible wall adjacent peripheral edge is wrapped, said member with wrapped wall is secured by means, within an open mouthed channel anchored in the river bed whereby said wrapped wall is clamped intermediate said member and said channel and said flexible wall extends upwardly through said mouth, said member having an outer surface substantially complimenting the shape of the inner surface of said channel and said lower peripheral edge including a bulbous portion extends into said mouth and is secured to said member.

14. A flexible wall dam as defined in claim 13, wherein said channel comprises, in cross-section, a substantially "C"-shaped configuration.

15. A flexible wall dam as defined in claim 14, wherein said member comprises a plurality of parts receivable through said mouth whereby said member may be assembled within said channel in piece-meal manner.

16. A flexible wall dam as defined in any of claims 1 or 84, wherein said flexible wall is constructed using a plurality of flexible wall sections joined together adjacent peripheral edges thereof whereby each section when applied to said flexible wall increases the wall surface area thereof, said wall sections comprising sheeting material having embodied therein reinforcement which extends through said peripheral edges thereof to facilitate said joining.

17. A flexible wall dam as defined in claim 16, wherein said reinforcement includes a plurality of plate-like members selectively positioned within said sheeting in planar alignment therewith and providing anchoring means for said system of cables.

18. A flexible wall dam as defined in claim 1, wherein a plurality of vessels are linked together in tandem arrangement, one behind the other, along said upper peripheral edge of said flexible wall and a plurality of said further vessels are linked together in tandem arrangement one behind the other and similarly anchored in position to the river bed and said flexible wall.

19. A flexible wall dam as defined in claim 6, wherein said system of cables adjacent said vessel includes a cable extending lengthwise of said vessel and spaced intermediate said vessel and said flexible wall, said cable being supported by a plurality of pulleys extending outwardly of said flexible wall and outwardly of said first side of said vessel, in a dam supporting position.

20. A flexible wall dam as defined in claim 19, wherein said plurality of pulleys extending outwardly of said flexible wall are connected respectively to a pulley block having a plurality of pulleys which in turn are connected by cable means to pulleys secured to said flexible wall.

21. A flexible wall dam as defined in claim 1 wherein said vessel comprises a watergoing vessel such as a ship or the like, especially one destined for retirement from regular service.

22. A flexible wall dam as described in claim 1 using a flexible, impermeable, inextensible plate shaped in form of long strips of average 5 to 15 feet wide and with lengths cut to measure and with varied thickness up to 5 inches or more, made of fabric, nylon, rubber or rubberized material or the like, cross reinforced internally with steel wires and steel wire ropes, fabric cords, nylon cords or the like, with reinforcement is made of one or multi layers where in the case of metallic reinforcement, metallic or hard plastic bearing plates are used with the metallic reinforcement to distribute the load of the cables acting on the material of the flexible wall to prevent the metallic reinforcement from cutting through the material of the flexible wall, and in certain cases the reinforcement wires and cords are imbedded during manufacturing into a sort of irregular fins of hard rubberized material or hard plastic to enlarge the cross section of the reinforcing wires or cords to a point where hard bearing plates would be no more needed for said wires and cords flexible wall reinforcement, with the said reinforcement left protruding on all the four sides of the strips with zig zag reinforcement and with loops to provide for splicing of the strips, to allow the installation of the flexible wall gradually strip by strip, where the edges of the strips are approached to each other on site and wire ropes are inserted consecutively through the loops of both adjacent edges of the strips that have to be joined, from one end of the strips to the other end along the long edges and the short edges of the strips where the adjacent loops are also tied with separate ties and clamps to make the adjacent strips firmly connected to each other to develop full strength as the strips themselves and then a rubberized splicing compound is applied on the joint to make it impermeable, which fact renders the flexible wall a continuous flexible plate with the same strength all along, a fact which allows the installation of the whole flexible wall, gradually on site, with the strips forming the flexible wall installed either in about the horizontal position, with the reinforcement and the thickness of the strips stepped up from one strip to the other as the flexible wall goes deeper from the surface of the water to the waterbed, to sustain the increasing water pressure, with the lowest strip at the water bed made thicker and with heavier reinforcement than the strip located at the surface of the water, or as the case may require, with the strips laid in about the vertical or inclined position with similar strips for the whole flexible wall, and where, for deep water dams, additional flexible walls are installed and cemented at the back of the main flexible wall, but with the strips led perpendicular and diagonal to the direction in which the strips of the main flexible wall were installed, which additional flexible walls are connected to the main flexible wall at different spots to make all the flexible walls act together at the same time, where the flexible wall, simple or composite, as is the case is also inserted at its lower end into a continuous curvaceous tubular channel with restricted mouth opening designed in combination with the flexible wall and anchored on the waterbed to secure a tight and firm anchorage of the lower end of the flexible wall by squeezing the flexible wall by means of longitudinal blocks that wedge together inside the curvaceous channel and interlock with each other to squeeze the flexible wall in between the wall of the curvaceous channel and the said blocks, and where the upper edge of the flexible wall is split in the form of the letters Y somewhere below the surface of the water and one branch of the split flexible wall is made shorter and is connected to a series of cables and pulleys acting like a spring and connected to a header cable which header cable is tied with separate ties that pass through watertight packaged holes, provided in the walls of the buoyants somewhere below the water level, where the structure of the buoyants is stronger and need little reinforcement to support the loads transferred to them though the ties, beyond which holes, the ties connecting the header cable are fastened to motorized equipment, installed inside the buoyants, and are used to move the flexible wall to and from the buoyants, which buoyants are tied back, on the opposite side, with anchoring cables to fixed points somewhere upstream, and where the other branch of the split Y shaped flexible wall is made longer and extended higher up to be connected to a series of cables and pulleys and a header cable that is tied to motorized equipment mounted inside the buoyants, in the same way as the shorter branch of the split flexible wall is connected but at a level higher than where the short split of the flexible wall was connected, where the flexible wall, being tightly and firmly anchored at its lower end, to the curvaceous tubular channel, installed on the waterbed, acts like an impermeable curtain that holds the water which causes the buoyants, which are in this case used ships, to float and pull up with them the flexible wall, where in order to profit of the strength of the structure of the buoyants where they are stronger, and to minimize the tendency of the flexible wall to pull the buoyant flat on its side, the upper edge of the flexible wall was split and the heavier split was connected to the lower part of the buoyants somewhere below the water level always allowing the water level to rise past the lower connection of the flexible wall to the buoyants and in order to allow the buoyants to develop full buoyant capacity, the other split of the flexible wall is made lighter and extended upward to allow the water to rise around the buoyants so that the buoyants would develop their full buoyant capacity where the whole system acts together in such a way that as long as the water, held by the flexible wall, rises, the buoyants floating on the water surface, rise also pulling with them continuously the top edges of the flexible wall until an equilibrium is reached between the floating capacity of the buoyants from one side and the vertical components of the forces acting on the flexible wall and on the anchoring lines, from the other side.

23. A flexible wall dam as described in claim 1 where the lower end of the flexible wall is anchored to the water bed by being inserted through a continuous, curvaceous, tubular channel with restricted mouth opening laying all along the dam and fastened to the waterbed, where the lower end of the said flexible wall is rolled around longitudinal blocks inserted inside the curvaceous channel all along the lengths of the dam where such blocks interlock among each other to form a kind of wedge that squeezes the flexible wall inside the curvaceous channel to be well anchored inside the channel while the very tip of the flexible wall ends in the form of a ring provided with slots along the lengths of the flexible wall which slots allow the insertion of solid blocks of wood, metal, plastic or the like, which blocks prevent the end of the flexible wall from slipping out in between the wall of the curvaceous channel and the said blocks, and also that the very tip of the flexible wall ends alternatively, for thinner plates, with a form of loop folded around longitudinal blocks and fastened to other longitudinal blocks which loop equally prevents the edge of the flexible wall from slipping through the curvaceous channel, and again another alternative where the flexible wall is not provided with a loop at its lower end, then the lower end of the flexible wall is folded back and inserted in between the longitudinal blocks, installed inside the curvaceous channel, before such blocks are wedged to interlock with each other, where at the same time additional ties connected to hardware fastened inside the curvaceous channel, passed through tight holes provided for them at the lower end of the flexible wall, then through the longitudinal blocks and are fastened over separate hardware that bridge over the back of the longitudinal blocks to keep them tight in place.

24. A flexible wall dam as described in claim 1 using in combination open or closed, upright, longitudinal, solid buoyants consisting of used ships or watergoing vessels of any type, that are destined for retirement, or that their prices have been substantially reduced but that they could still safely deliver their floating capacity to support the vertical loads transferred to them from the flexible wall and that their structure is still strong enough to absorb and transfer, if necessary, the horizontal and transversal loads transferred to them from the flexible wall which loads could be transferred if necessary from the flexible wall, directly through the transversal structure of the vessels, or indirectly to the anchoring ties, which vessels are fitted and modified to support the flexible wall, that retains the water that causes the vessels to float and pull up with them the upper edges of the flexible wall, while these ships are tied back on the opposite side of the water retaining flexible wall with ties that connect them back upstream to fixed anchoring points, where these vessels, are fitted, in their lowerpart along their long sides, with watertight openings in their outside walls that allow the entrance of the cables transferring the loads from the lower split of the upper edge of the flexible wall, without allowing the passage of the water through these holes where these cables extend inside the vessels and are connected to motorized equipment fastened on the decks of the vessels, which said motorized equipment are used to move the flexible wall to and from the vessels, while the upper part of the vessels is covered to be watertight in order to increase the floating capacity of the vessels and again is fitted with watertight holes that would receive the cables transferring the loads from the upper split at the top edge of the flexible wall, which said cables are connected inside the vessels to upper motorized equipment mounted on the upper decks of the vessels and which motorized equipment are used to move the upper split at the top of the flexible wall to and from the vessels, in a way that the lower part of the vessels, where the structure is heavier, would be supporting the heavier parts of the cables, transferring the main loads of the upper edge of the flexible wall, which fact also minimizes the tendency of the flexible wall to pull down the vessels flat on their sides where water could get through and drown the vessels, and where on the other hand the upper parts of the vessels receive the upper split of the top edge of the flexible wall which is supposed to transfer lighter loads from the flexible wall to the vessels, a fact which would minimize the additional reinforcement required on the vessels and would minimize the tendency of the flexible wall to overturn the vessels flat on their sides, a joint combination between the flexible wall and the used ships made in such a way to insure the use of the maximum capacity of the vessels while the flexible wall would retain the highest level of water possible insuring a dam with the lowest cost and the fastest time of construction possible.

25. A flexible wall dam as described in claim 1 where the span of the flexible wall in between the waterbed and the surface of the water, is divided into multi spans by introducing, on the back of the flexible wall, supporting cables playing the role of beams at different intervals between the water bed and the surface of the water, which beams transfer the loads from the back of the flexible wall, to anchoring cables connected to them at different spacing, through the flexible wall, which anchoring cables extend somewhere upstream; some of them directly to their anchoring points on the waterbed or on other fixed points upstream; while, in order to absorb the vertical components of the stress transferred from the beams on the back of the flexible wall, other anchoring cables connected to said beams extend upward, pass through additional buoyants that are used ships stationed in front of the main buoyants on the surface of the water at the high water level where said cables are connected to equipment fastened inside said additional buoyants, which buoyants are in turn tied back upstream with ties tying them to achoring points on the waterbed or on other fixed points upstream, where at the same time the supporting beams at the back of the flexible wall are interconnected with cables in the form of zig zag tying them to each other and to the top and lower edge of the flexible wall to keep said cable beams in a certain spacing from each other, and to act as additional supporting beams, where at the same time, additional cable beams, vertical, horizontal and diagonal to the flexible wall, are used to support the additional flexible walls that are used to support the main flexible wall, which additional flexible walls have their strips built perpendicular and diagonal to the direction of the strips forming the main flexible wall where also the said supporting cable beams are connected through the said flexible walls to anchoring ties anchored to the waterbed upstream.

26. A flexible wall dam as described in claim 1 where the top edges of the flexible wall rolled separately around a cable and clamped together with the cable by means of clamps provided at their opposite ends with pulleys connected to a continuous cable that transmits the loads from the clamps to other pulleys mounted betwen pairs of solid beams, and at the same time allows the flexibility in the connection in a way that the pressure at the top edge of the flexible wall is balanced due to the continuous cable which is free to get longer under higher pressure on one clamp while it gets shorter on the other clamp, so transferring a smooth pressure to the beams above the clamps, which beams are themselves connected with continuous cables as well to blocks of pulleys above them which fact allows the beams also to tilt to one side or the other according to the pressure transmitted to them from the flexible wall, where the beams and the clamps act together as double springs to equalize the pressure on the top of the flexible wall while the beams also continue to transmit the loads to blocks of pulleys above them by means of continuous cables connecting them to the pulleys above them, which pulleys transfer their loads to a header cable above them, where the header cable itself is carried by a block of pulleys that transmit the loads from the header cable to other cables tied to them and carrying the resultant loads from the flexible wall over to the floating vessel.

27. A flexible wall dam as described in claim 1 using sets of cables and pulleys connecting the upper edges of the flexible wall where the header cable supporting the lower sets of said cables and pulleys is tied to the series of ties which pass through watertight packaged holes cut in the lower part of the buoyants along the long side of the buoyants, then said ties pass over bearing shafts or drums mounted inside the buoyants and extend further to be connected to equipment fastened inside the buoyants, which equipment are used to move the flexible wall to and from the buoyants, while on the other hand, the header cable supporting the upper split of the flexible wall is tied in the same way to motorized equipment fastened inside the buoyants at levels higher than the level holding the equipment supporting the lower split of the flexible wall which carries the bulk of the loads of the flexible wall.

28. A flexible wall dam as described in claim 1 where the flexible wall is anchored and supported by buoyants, consisting of used ships or watergoing vessels of any kind, where these buoyants are tied back upstream with ties that tie them to anchoring sites on the waterbed or on other fixed sites upstream where on their opposed sides, these ties enter the buoyants at different levels along the long sides of the buoyants, through watertight holes cut in the walls of said buoyants, and after which holes, the ties pass over bearing drums and extend further to be connected to equipment whose role it is to move the buoyants to and from the anchoring sites, where apart from the ties entering the buoyants at different levels and tying said buoyants to their anchoring sites, still additional ties are brought from the connecting equipment, inside the buoyants, over additional bearing drums mounted towards the edge of the buoyants facing the anchoring ties, at a level higher than the level where, the opposite ties tying the flexible wall to the buoyants, enter the buoyants, before being turned to connect to the main anchoring ties, which fact gives a lever arm to such additional ties to counterbalance the tendency of the flexible wall to overturn the buoyants flat along their sides.

29. A flexible wall dam as described in claim 1 where the flexible wall is anchored at its lower end to a curvaceous, continuous tubular channel with restricted mouth opening, which channel is laid flat on the waterbed along the length of the dam with the upper section of the channel left open to allow the insertion of the flexible wall and the longitudinal blocks holding the flexible wall etc., where such a curvaceous tubular channel is reinforced outside with webs welded to the outside wall of the channel to prevent the flexible wall from causing the channel to open so releasing the flexible wall and the longitudinal blocks holding it and where at the same time, to anchor the curvaceous channel to the waterbed, reinforcing bars are welded on the outside of the channel and on the webs reinforcing it and rooting down through a massive concrete platform poured on the surface of the waterbed which platform anchors the curvaceous channel from one side and concrete and wooden piles driven in the waterbed from the other side, where the reinforcement at the top of the concrete piles is left protruding up through the concrete platform to make bondage between the concrete platform and the concrete piles and where in the case of wooden piles, the wooden piles are provided with transversal holes at the top of the piles to allow the insertion of reinforcing bars through the wooden piles, which reinforcing bars extend on both sides of the wooden piles through the concrete platform to make bond between the wooden piles and the concrete platform in such a way that the concrete platform by joining the reinforcing bars from the curvaceous channel and from the concrete and wooden piles it acts like an anchoring agent that anchors the curvaceous channel to the waterbed, and at the same time the piles driven into the waterbed help holding the earth beneath the concrete platform and prevent seepage of water from underneath the concrete platform, a system which is duplicated further upstream to offer anchorage to the ties tying back the buoyants to the waterbed with a difference that the curvaceous channel houses only longitudinal blocks that are tied to each other to make one massive longitudinal block after being inserted into the channel and at the same time the two edges of the open channel are tied to each other after the insertion of the longitudinal blocks to prevent the slipping out of said blocks, where at the same time, the curvaceous channel is cut at different intervals to allow the insertion of the buoyants' anchoring ties around the longitudinal blocks.

30. A flexible wall dam as described in claim 1 where the flexible wall is provided with openings made in the lower part of the flexible wall, to which openings a kind of flexible funnels or spouts are connected which funnels would discharge the water outward into electric generating turbines mounted on secondary vessels stationed outside the flexible wall on the lower water side.

31. A flexible wall dam as described in claim 1 using in combination a flushing out system consisting of tunnels beginning upstream ahead of the anchoring points and extending at the surface of the waterbed through the concrete platform to points downstream beyond the flexible wall, where such tunnels are provided at their beginning with locks that allow the opening and closing of the water through the tunnels and in order to prevent rocks from blocking the entrance of the tunnels, sets of piles are driven in the waterbed at a short distance from the mouth of the tunnels and left protruding for a distance high above the waterbed, which piles play the role of a screen preventing large rocks from advancing to the tunnels and blocking them.

* * * * *